US010989027B2

(12) United States Patent
Artinian et al.

(10) Patent No.: US 10,989,027 B2
(45) Date of Patent: Apr. 27, 2021

(54) ARTIFICIAL LIFT

(71) Applicant: Upwing Energy, LLC, Cerritos, CA (US)

(72) Inventors: Herman Artinian, Huntington Beach, CA (US); Kuo-Chiang Chen, Kennedale, TX (US); Patrick McMullen, Villa Park, CA (US); David Biddick, Houston, TX (US)

(73) Assignee: Upwing Energy, LLC, Cerritos, CA (US)

( * ) Notice: Subject to any disclaimer, the term of this patent is extended or adjusted under 35 U.S.C. 154(b) by 0 days.

(21) Appl. No.: 16/554,106

(22) Filed: Aug. 28, 2019

(65) Prior Publication Data

US 2020/0032630 A1 Jan. 30, 2020

Related U.S. Application Data

(63) Continuation-in-part of application No. 16/047,983, filed on Jul. 27, 2018, now Pat. No. 10,370,947, and (Continued)

(51) Int. Cl.
*E21B 43/12* (2006.01)
*F04D 29/58* (2006.01)
(Continued)

(52) U.S. Cl.
CPC ..... *E21B 43/128* (2013.01); *E21B 34/06* (2013.01); *F04D 13/086* (2013.01); *F04D 29/5806* (2013.01)

(58) Field of Classification Search
CPC .... E21B 34/06; E21B 43/128; F04D 13/0613; F04D 13/0626; F04D 13/086;
(Continued)

(56) References Cited

U.S. PATENT DOCUMENTS 2,283,118 A 5/1942 Armais
4,768,595 A 9/1988 Smith
(Continued)

FOREIGN PATENT DOCUMENTS

WO 2006126886 11/2006
WO 2017021553 2/2017

OTHER PUBLICATIONS

PCT International Search Report and Written Opinion issued in International Application No. PCT/US2019/048,547, dated Feb. 4, 2020, 21 pages.

(Continued)

*Primary Examiner* — David Carroll
(74) *Attorney, Agent, or Firm* — Fish & Richardson P.C.

(57) ABSTRACT

An electric submersible pump (ESP) is described. The ESP includes a stator chamber, a stator within the stator chamber, a rotor, and an electrical connection. The stator chamber is configured to reside in a wellbore. The stator chamber is configured to attach to a tubing of a well. The stator chamber defines an inner bore having an inner bore wall that, when the stator chamber is attached to the tubing, is continuous with an inner wall of the tubing. The rotor is positioned within the inner bore of the stator chamber. The rotor includes an impeller. The rotor is configured to be retrievable from the well while the stator remains in the well. The stator is configured to drive the rotor to rotate the impeller and induce well fluid flow in response to receiving power through the electrical connection.

26 Claims, 9 Drawing Sheets

Related U.S. Application Data a continuation-in-part of application No. 16/047,937, filed on Jul. 27, 2018, now Pat. No. 10,253,606, and a continuation-in-part of application No. 16/047,981, filed on Jul. 27, 2018, now Pat. No. 10,280,721.

(60) Provisional application No. 62/724,458, filed on Aug. 29, 2018.

(51) Int. Cl.
*F04D 13/08* (2006.01)
*E21B 34/06* (2006.01)

(58) Field of Classification Search
CPC .... F04D 13/10; F04D 29/5806; F04D 29/628; F04D 29/708; F05D 2230/70; F05D 2260/607
See application file for complete search history.

(56) References Cited

U.S. PATENT DOCUMENTS 5,620,048 A * 4/1997 Beauquin ..... F04B 47/06 166/62
5,988,992 A * 11/1999 Tetzlaff ..... E21B 43/128 166/98
6,167,965 B1 * 1/2001 Bearden ..... E21B 43/385 166/250.15
6,557,642 B2 5/2003 Head
6,695,594 B1 2/2004 Pastori
2001/0050173 A1 * 12/2001 Head ..... E21B 17/028 166/381
2005/0217859 A1 * 10/2005 Hartman ..... E21B 43/38 166/369
2009/0272129 A1 * 11/2009 Petty ..... H02K 5/132 62/64
2011/0044831 A1 * 2/2011 Cunningham ..... H02K 5/1285 417/410.1
2011/0050173 A1 * 3/2011 King ..... H02J 1/10 320/128
2011/0079391 A1 4/2011 Bedouet et al.
2014/0182836 A1 7/2014 Irani et al.
2020/0072245 A1 3/2020 Chen et al.

OTHER PUBLICATIONS

PCT Internatioral Search Report and Written Opinion issued in International Application No. PCT/US2019/043587, dated Oct. 16, 2019, 23 pages.

* cited by examiner

ARTIFICIAL LIFT

CROSS-REFERENCE TO RELATED APPLICATIONS

This application claims the benefit of priority to U.S. Provisional Application Ser. No. 62/724,458 filed on Aug. 29, 2018. This application is also a Continuation in Part of U.S. patent application Ser. No. 16/047,937, now issued as U.S. Pat. No. 10,253,606 on Apr. 9, 2019, U.S. patent application Ser. No. 16/047,983, now issued as U.S. Pat. No. 10,370,947 on Aug. 6, 2019, and U.S. patent application Ser. No. 16/047,981, now issued as U.S. Pat. No. 10,280,721 on May 7, 2019, the contents of which is hereby incorporated by reference in its entirety.

TECHNICAL FIELD

This disclosure relates to artificial lift systems.

BACKGROUND

Artificial lift equipment, such as electric submersible pumps, compressors, and blowers, can be used in downhole applications to increase fluid flow within a well, thereby extending the life of the well. Such equipment, however, can fail due to a number of factors. Equipment failure can sometimes require workover procedures, which can be costly. On top of this, workover procedures can include shutting in a well in order to perform maintenance on equipment, resulting in lost production. Lost production negatively affects revenue and is therefore typically avoided when possible.

SUMMARY

Certain aspects of the subject matter described here can be implemented as an electric submersible pump (ESP). The ESP includes a stator chamber, a stator within the stator chamber, a rotor, and an electrical connection connected to the stator chamber. The stator chamber is configured to reside in a wellbore. The stator chamber is configured to attach to a tubing of a well. The stator chamber defines an inner bore having an inner bore wall that, when the stator chamber is attached to the tubing, is continuous with an inner wall of the tubing. The rotor is positioned within the inner bore of the stator chamber. The rotor includes an impeller. The rotor is configured to be retrievable from the well while the stator remains in the well. The electrical connection is configured to supply power to electrical components of the stator. The stator is configured to drive the rotor to rotate the impeller and induce well fluid flow in response to receiving power through the electrical connection.

This, and other aspects, can include one or more of the following features.

The stator chamber can be flooded with a fluid.

The ESP can include a coolant flooding the stator chamber.

The ESP can include a fluid connection connected to the stator chamber. The fluid connection can be configured to supply coolant to the stator chamber from a remote location.

The fluid connection can include an injection valve configured to inject coolant into the well fluid.

When the ESP is installed in the well, the fluid connection can run from the remote location to the stator chamber through an annulus defined between a casing of the well and the tubing of the well.

The rotor can define an inner bore through which fluid can flow once the ESP is installed in the well.

The stator chamber can define multiple radial apertures configured to allow fluid to flow radially into or out of an inner bore of the stator chamber.

The plurality of radial apertures can be configured to allow fluid to flow into or out from the inner bore of the stator chamber and into or out from an annulus between the stator chamber and a wall of the well.

The radial apertures can include a first set of radial apertures, when the ESP is attached to the tubing of the well, located downhole of the impeller.

The radial apertures can include a second set of radial apertures, when the ESP is attached to the tubing of the well, located uphole of the impeller.

The ESP can include a downhole end defining an opening configured to allow solid material to fall out of the ESP, such that the solid material is not produced with the well fluid.

The ESP can include a protector located at a downhole end of the ESP. The protector can include a bearing configured to control levitation of the rotor within the inner bore of the stator chamber.

The stator chamber can house a magnetic bearing.

The ESP can include a damper configured to dampen a vibration of the rotor.

Certain aspects of the subject matter described here can be implemented as a method. An ESP is installed within a well formed in a subterranean zone. The ESP includes a stator chamber, a stator within the stator chamber, a rotor, and an electrical connection connected to the stator chamber. The stator chamber is attached to a tubing of the well. The stator chamber defines an inner bore having an inner bore wall that is continuous with an inner wall of the tubing. The rotor is positioned within the inner bore of the stator chamber. The rotor includes an impeller. The rotor is configured to be retrievable from the well while the stator remains within the well. Power is supplied through the electrical connection to the stator to drive the rotor to rotate the impeller and induce well fluid flow.

This, and other aspects, can include one or more of the following features.

The rotor can be retrieved from the well while the stator remains within the well.

The ESP can include a fluid connection connected to the stator chamber. A coolant can be flowed through the fluid connection to the stator chamber from a remote location.

Well fluid can be flowed through an inner bore of the rotor.

Well fluid can be flowed through multiple radial apertures defined by the stator chamber.

The radial apertures can include a first set of radial apertures located downhole of the impeller. At least a portion of the well fluid can be flowed into an inner bore of the stator chamber through the first set of radial apertures.

The radial apertures can include a second set of radial apertures located uphole of the impeller. At least a portion of the well fluid can be flowed out of the inner bore of the stator chamber through the second set of radial apertures.

Solid material can be allowed to fall out of the ESP through an opening defined in a downhole end of the ESP, such that the solid material is not produced with the well fluid.

Levitation of the rotor within the inner bore of the stator can be controlled using a bearing of a protector located at a downhole end of the ESP.

Certain aspects of the subject matter described here can be implemented as an ESP. The ESP includes a stator chamber encasing a stator and a rotor-impeller. The stator chamber is configured to be attached to a tubing of a well. The stator chamber defines an inner bore having an inner, circumferential wall that, when the stator chamber is attached to the tubing, is continuous with an inner, circumferential wall of the tubing. The rotor-impeller is configured to be positioned within the inner bore of the stator chamber. The rotor-impeller is configured to be retrievable from the well while the stator remains within the well.

This, and other aspects, can include one or more of the features described previously.

DESCRIPTION OF DRAWINGS

Like reference symbols in the various drawings indicate like elements.

DETAILED DESCRIPTION

This disclosure describes artificial lift systems. Artificial lift systems installed downhole are often exposed to hostile downhole environments. Artificial lift system failures are often related to failures in the electrical system supporting the artificial lift system. In order to avoid costly workover procedures, it can be beneficial to isolate electrical portions of such artificial lift systems to portions of a well that exhibit less hostile downhole environments in comparison to the producing portions of the well. The subject matter described in this disclosure can be implemented in particular implementations, so as to realize one or more of the following advantages. Use of such artificial lift systems can increase production from wells. In some implementations, the electrical components of the artificial lift system are separated from rotating portions of the artificial lift system, which can improve reliability in comparison to artificial lift systems where electrical systems and electrical components are integrated with both non-rotating and rotating portions. The artificial lift systems described herein can be more reliable than comparable artificial lift systems, resulting in lower total capital costs over the life of a well. The improved reliability can also reduce the frequency of workover procedures, thereby reducing periods of lost production and maintenance costs.

Figure 1:
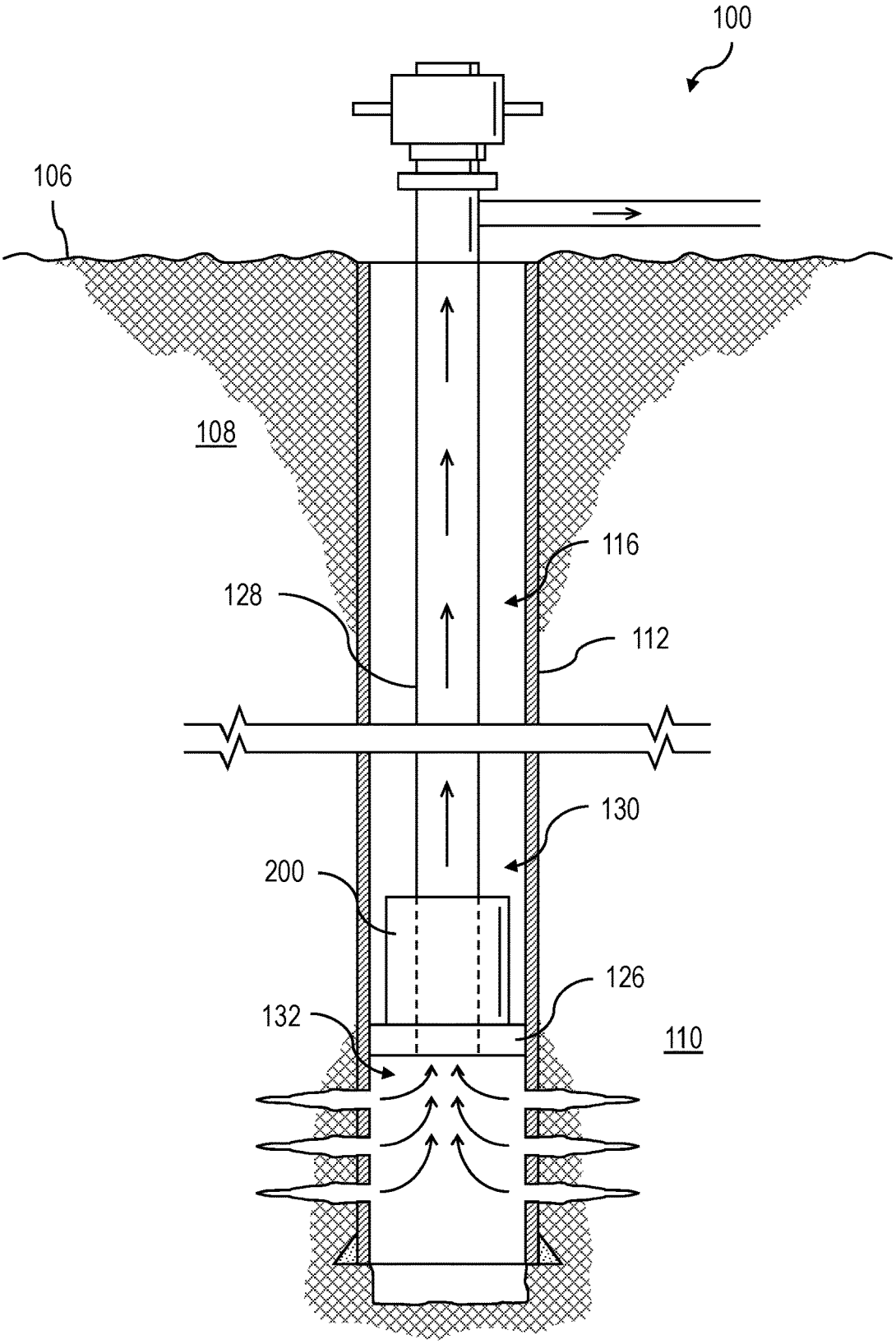
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured in any significant amount. For simplicity's sake, the well 100 is shown as a vertical well, but in other instances, the well 100 can be a deviated well with a wellbore deviated from vertical (for example, horizontal or slanted) and/or the well 100 can include multiple bores, forming a multilateral well (that is, a well having multiple lateral wells branching off another well or wells).

In some implementations, the well 100 is a gas well that is used in producing natural gas from the subterranean zones of interest 110 to the surface 106. While termed a "gas well," the well need not produce only dry gas, and may incidentally or in much smaller quantities, produce liquid including oil and/or water. In some implementations, the well 100 is an oil well that is used in producing crude oil from the subterranean zones of interest 110 to the surface 106. While termed an "oil well,": the well not need produce only crude oil, and may incidentally or in much smaller quantities, produce gas and/or water. In some implementations, the production from the well 100 can be multiphase in any ratio, and/or can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources, and/or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly and/or otherwise) end-to-end of the same size or of different sizes. In FIG. 1, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1 shows well 100 being produced with a Christmas tree attached the wellhead. The Christmas tree includes valves used to regulate flow into or out of the well 100. The well 100 also includes an electric submersible pump 200 (ESP) residing in the wellbore, for example, at a depth that is nearer to subterranean zone 110 than the surface 106. The ESP 200, being of a type configured in size and robust construction for installation within a well 100, can include any type of ESP that can assist production of fluids to the surface 106 and out of the well 100 by creating an additional pressure differential within the well 100. Also, notably, while the concepts herein are discussed with respect to an ESP, they are likewise applicable to other types of pumps, compressors, blowers and devices for moving multi-phase fluid.

Figure 2:
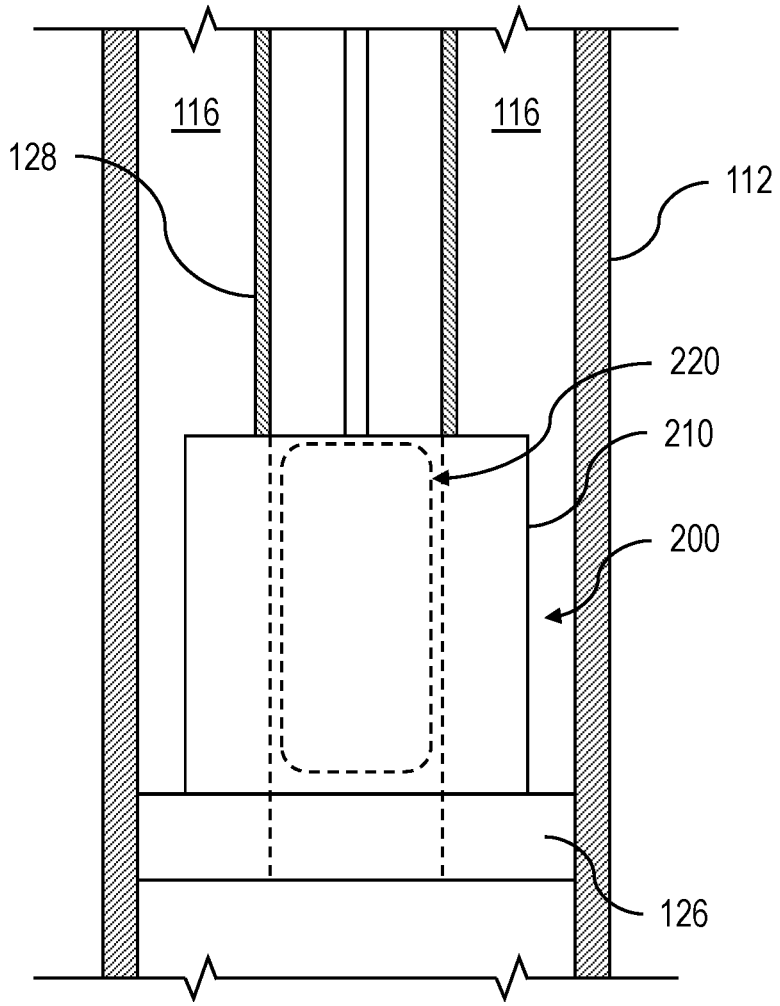
FIG. 2 is a schematic diagram of an example electric submersible pump (ESP) within the well of FIG. 1.

In particular, casing 112 is commercially produced in a number of common sizes specified by the American Petroleum Institute (the "API), including 4-½, 5, 5-½, 6, 6-⅝, 7, 7-⅝, 16⅝, 9-⅝, 10-¾, 11-¾, 13-⅜, 16, 116/8 and 20 inches, and the API specifies internal diameters for each casing size. The system 200 can be configured to fit in, and (as discussed in more detail below) in certain instances, seal to the inner diameter of one of the specified API casing sizes. Of course, the ESP 200 can be made to fit in and, in certain instances, seal to other sizes of casing or tubing or otherwise seal to a wall of the well 100. As shown in FIGS. 1 and 2, the ESP 200 can attach to a production tubing 128 in the well 100. Portions of the ESP 200 do not need to reside within the tubing 128 and can have dimensions that are larger than the inner diameter of the tubing 128. The largest outer diameter of the ESP 200 can therefore be larger than the inner diameter of the tubing 128.

Additionally, the construction of the components of the ESP 200 are configured to withstand the impacts, scraping, and other physical challenges the ESP 200 will encounter while being passed hundreds of feet/meters or even multiple miles/kilometers into and out of the well 100. For example, the ESP 200 can be disposed in the well 100 at a depth of up to 20,000 feet (6,096 meters). Beyond just a rugged exterior, this encompasses having certain portions of any electrical components being ruggedized to be shock resistant and remain fluid tight during such physical challenges and during operation. Additionally, the ESP 200 is configured to withstand and operate for extended periods of time (e.g., multiple weeks, months or years) at the pressures and temperatures experienced in the well 200, which temperatures can exceed 400° F./205° C. and pressures over 2,000 pounds per square inch, and while submerged in the well fluids (gas, water, or oil as examples). Finally, the ESP 200 can be configured to interface with one or more of the common deployment systems, such as jointed tubing (that is, lengths of tubing joined end-to-end, threadedly and/or otherwise), sucker rod, coiled tubing (that is, not-jointed tubing, but rather a continuous, unbroken and flexible tubing formed as a single piece of material), slickline (that is, a single stranded wire), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector).

A seal system 126 integrated or provided separately with a downhole system, as shown with the ESP 200, divides the well 100 into an uphole zone 130 above the seal system 126 and a downhole zone 132 below the seal system 126. FIG. 1 shows the ESP 200 positioned in the open volume of the bore 116 of the casing 112, and connected to a production string of tubing (also referred as production tubing 128) in the well 100. The wall of the well 100 includes the interior wall of the casing 112 in portions of the wellbore having the casing 112, and includes the open hole wellbore wall in uncased portions of the well 100. Thus, the seal system 126 is configured to seal against the wall of the wellbore, for example, against the interior wall of the casing 112 in the cased portions of the well 100 or against the interior wall of the wellbore in the uncased, open hole portions of the well 100. In certain instances, the seal system 126 can form a gas- and liquid-tight seal at the pressure differential the ESP 200 creates in the well 100. For example, the seal system 126 can be configured to at least partially seal against an interior wall of the wellbore to separate (completely or substantially) a pressure in the well 100 downhole of the seal system 126 from a pressure in the well 100 uphole of the seal system 126. For example, the seal system 126 includes a production packer. Although not shown in FIG. 1, additional components, such as a surface pump, can be used in conjunction with the ESP 200 to boost pressure in the well 100.

In some implementations, the ESP 200 can be implemented to alter characteristics of a wellbore by a mechanical intervention at the source. Alternatively, or in addition to any of the other implementations described in this specification, the ESP 200 can be implemented in a direct well-casing deployment for production through the wellbore. Other implementations of the ESP 200 can be utilized in conjunction with additional pumps, compressors, or multiphase combinations of these in the well bore to effect increased well production.

The ESP 200 locally alters the pressure, temperature, and/or flow rate conditions of the fluid in the well 100 proximate the ESP 200. In certain instances, the alteration performed by the ESP 200 can optimize or help in optimizing fluid flow through the well 100. As described previously, the ESP 200 creates a pressure differential within the well 100, for example, particularly within the locale in which the ESP 200 resides. In some instances, a pressure at the base of the well 100 is a low pressure (for example, sub-atmospheric); so unassisted fluid flow in the wellbore can be slow or stagnant. In these and other instances, the ESP 200 introduced to the well 100 adjacent the perforations can reduce the pressure in the well 100 near the perforations to induce greater fluid flow from the subterranean zone 110, increase a temperature of the fluid entering the ESP 200 to reduce condensation from limiting production, and/or increase a pressure in the well 100 uphole of the ESP 200 to increase fluid flow to the surface 106.

The ESP 200 moves the fluid at a first pressure downhole of the ESP 200 to a second, higher pressure uphole of the ESP 200. The ESP 200 can operate at and maintain a pressure ratio across the ESP 200 between the second, higher uphole pressure and the first, downhole pressure in the wellbore. The pressure ratio of the second pressure to the first pressure can also vary, for example, based on an operating speed of the ESP 200. The ESP 200 can operate at a variety of speeds, for example, where operating at higher speeds increases fluid flow, and operating at lower speeds reduces fluid flow. In some implementations, the ESP 200 can operate at speeds up to 12,000 revolutions per minute (rpm). In some implementations, the ESP 200 can operate at lower speeds (for example, 4,000 rpm). Specific operating speeds for the ESP 200 can be defined based on the fluid (in relation to its composition and physical properties) and flow conditions (for example, pressure, temperature, and flow rate) for the well parameters and desired performance. Speeds can be, for example, as low as 1,000 rpm or as high as 12,000 rpm. While the ESP 200 can be designed for an optimal speed range at which the ESP 200 performs most efficiently, this does not prevent the ESP 200 from running at less efficient speeds to achieve a desired flow for a particular well, as well characteristics change over time.

The ESP 200 can operate in a variety of downhole conditions of the well 100. For example, the initial pressure within the well 100 can vary based on the type of well, depth of the well 100, production flow from the perforations into the well 100, and/or other factors. In some examples, the pressure in the well 100 proximate a bottomhole location is sub-atmospheric, where the pressure in the well 100 is at or below about 14.7 pounds per square inch absolute (psia), or about 101.3 kiloPascal (kPa). The ESP 200 can operate in sub-atmospheric well pressures, for example, at well pressure between 2 psia (13.8 kPa) and 14.7 psia (101.3 kPa). In some examples, the pressure in the well 100 proximate a bottomhole location is much higher than atmospheric, where the pressure in the well 100 is above about 14.7 pounds per square inch absolute (psia), or about 101.3 kiloPascal (kPa). The ESP 200 can operate in above atmospheric well pressures, for example, at well pressure between 14.7 psia (101.3 kPa) and 5,000 psia (34,474 kPa).

Referring to FIG. 2, the ESP 200 includes a stator chamber 210 and a rotor 220. A stator 211 resides within the stator chamber 210. The stator 211 is configured to drive rotation of the rotor 220 in response to receiving power (for example, power supplied via an electrical line from a remote location). The stator chamber 210 and stator 211 are described in more detail later. The rotor 220 can include a central rotating shaft 402 and impellers 432 (shown later in FIG. 4). The rotor 220 with the central shaft 402 and one or more impellers 432 can be called a rotor-impeller. In some implementations, the rotor 220 is free of electrical components. After installation of the ESP 200 in the well 100, the rotor 220 can optionally be retrieved from the well 100 while the stator 211 (and the stator chamber 210) remain within the well 100. The stator chamber 210 and the rotor 220 of the ESP 200 can be installed in the well 100 separately (physically and temporally). For example, the stator chamber 210 can be installed in the well 100, and then the rotor 220 can be installed in the well 100. In some implementations, once the rotor 220 is positioned at a desired location within the well 100, the rotor 220 can be coupled to the stator chamber 210 or a tubing of the well 100 (such as the production tubing 128) by a coupling part (not shown). Then, if desired, the rotor 220 can be decoupled from the stator chamber 210 or the production tubing 128 and be retrieved from the well 100, while the stator 211 remains in the well 100.

As shown in FIG. 2, there can be an air gap between the stator chamber 210 and the rotor 220. The air gap can be unsealed and of sufficient size to allow fluid flow through the ESP 200. The ESP 200 can include various protective sleeves (described in more detail later) to prevent components from being exposed to (and therefore protect them from) the production fluid. In some implementations, the rotor 220 interacts magnetically with the stator chamber 210 and is not mechanically connected to the stator chamber 210.

The ESP 200 can be exposed to production fluid from the subterranean zone 110. The rotation of the rotor 220 can induce fluid flow in the well 100 (for example, from the subterranean zone 110 to the surface 106). In some implementations, the ESP 200 can allow production fluid from the subterranean zone 110 to flow over an outer surface of the rotor 220. In some implementations, production fluid from the subterranean zone 110 flows through the annulus between the rotor 220 and the stator chamber 210. In some implementations, production fluid from the subterranean zone 110 can flow through an inner bore of the rotor 220.

The ESP 200 can include a protector configured to protect a portion of the rotor 220 against contamination of production fluid. The protector can include a thrust bearing, such as a mechanical thrust bearing or a magnetic thrust bearing with or without permanent magnets. The shaft 402 running through the protector can be coupled to the rotor 220 and also to the impellers 432, such that the shaft 402 and impellers 432 rotate with the rotating rotor 220. The protector can include face seals that prevent fluid from entering or exiting the protector. The protector can be filled with lubrication fluid (for example, lubrication oil)—that is, the thrust bearing can be submerged in lubrication fluid. In some implementations, the protector (including one or more thrust bearings) is located at one end of the ESP 200, for example, at a downhole end of the ESP 200. In such implementations, one end of the protector can be capped (some examples are shown in FIGS. 5A through 5D) and the other end of the protector can be coupled to the rotor 220. Such implementations can require only one set of seals (at the mating of the protector and the rotor 220), in contrast to configurations in which the protector is located between the pump section (the portion of the ESP 200 including the impellers 432) and the motor section (such configurations can require two sets of seals: one set at the mating of the protector and the pump section and another set at the mating of the protector and the motor section).

Although not shown, the protector can equalize pressure of the lubrication fluid to a production fluid while keeping the lubrication fluid relatively isolated from contamination by the production fluid for portions of the ESP 200 that do not need to interact with the production fluid (or would be adversely affected by exposure to the production fluid). The protector can include a flexible material that can expand or contract to equalize pressure within and outside the material to achieve pressure balance. The flexible material can be, for example, a rubber bag, a diaphragm, or a flexible metallic barrier. The flexible material can also serve to provide a barrier or a seal between the lubrication fluid and the production fluid. As the production fluid pressure increases, the flexible material can compress the lubrication fluid until the pressure of the lubrication fluid is equal to that of the production fluid, with no flow of production fluid into the lubrication fluid. The protector can include, in addition to or instead of the flexible material, a labyrinth chamber, which provides a tortuous path for the production fluid to enter the protector and mix with the lubrication fluid. The labyrinth chamber can provide another way to equalize pressure between the production fluid and the lubrication fluid. The lubrication fluid and the production fluid can balance in pressure, and the tortuous path of the labyrinth chamber can prevent downhole fluid from flowing further into the protector. The labyrinth chamber can be implemented for vertical orientations of the ESP 200. In some implementations, production fluid from the subterranean zone 110 can flow through the annulus between the protector and the stator chamber 210 (or the protective sleeve 390). In some implementations, production fluid from the subterranean zone 110 can flow through an inner bore of the protector.

Figure 3:
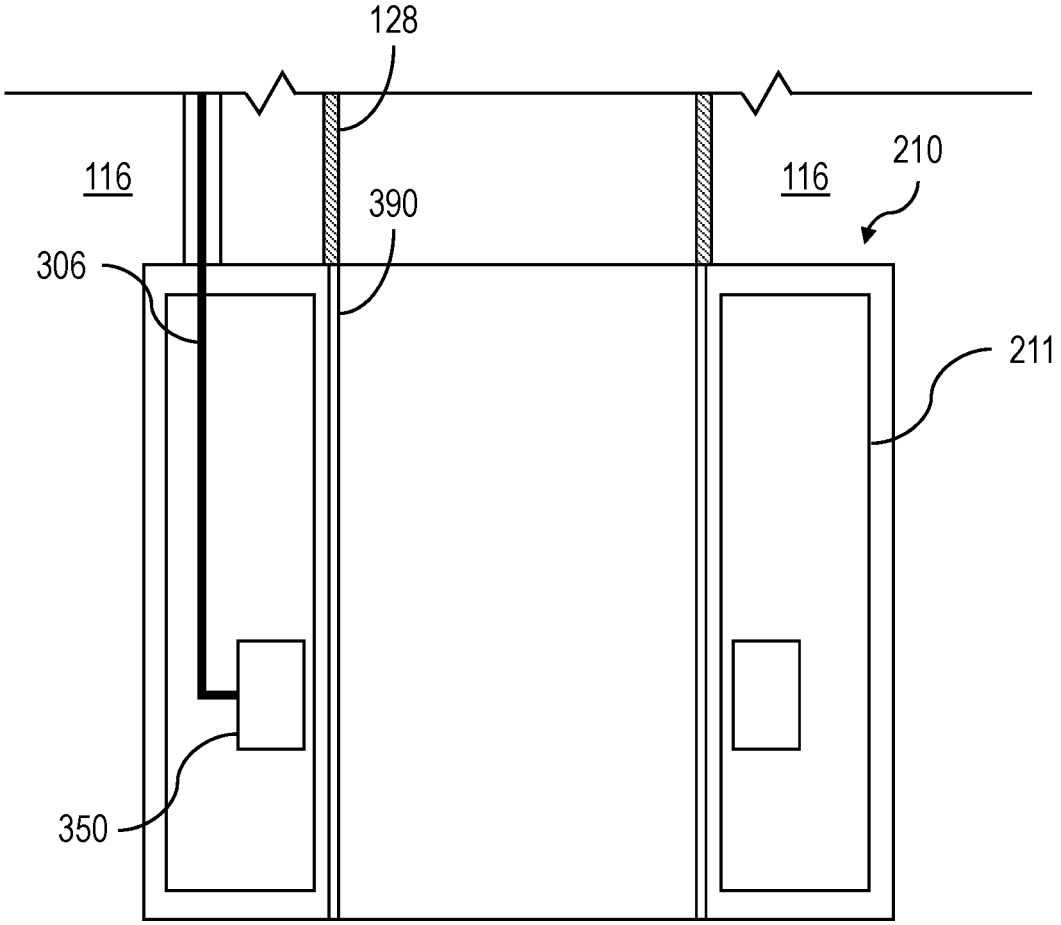
FIG. 3 is a schematic diagram of an example stator of the ESP of FIG. 2.

Referring to FIG. 3, the stator chamber 210 can attach to a tubing of the well 100 (for example, the production tubing 128). The stator chamber 210 can define an inner bore having an inner surface (for example, an inner, circumferential wall) defined by an inner diameter. When the stator chamber 210 is attached to the tubing (such as the production tubing 128), the inner, circumferential wall can be continuous with an inner, circumferential wall of the tubing (for example, the innermost circumferential wall of the tubing 128). The stator chamber 210 can be metallic or non-metallic. The stator chamber 210 can be made of a material suitable for the environment and operating conditions (for example, downhole conditions). In some implementations, the stator chamber 210 includes a protective sleeve 390. The protective sleeve 390 can protect the stator chamber 210 from production fluid, while also allowing magnetic flux to penetrate from the stator 211, through the stator chamber 210 and sleeve 390, and into the inner bore of the stator chamber 210. The protective sleeve 390 can be a part of (that is, integral to) the production tubing 128 or can be attached to the production tubing 128. The stator chamber 210 and/or the protective sleeve 390 can be made of, for example, carbon fiber or Inconel.

The stator 211 can include an electromagnetic coil 350. In response to receiving power, the electromagnetic coil 350 can generate a magnetic field to engage a motor permanent magnet of the rotor 220 and cause the rotor 220 to rotate. The electromagnetic coil 350 and the motor permanent magnet interact magnetically. The electromagnetic coil 350 and the motor permanent magnet each generate magnetic fields which attract or repel each other. The attraction or repulsion imparts forces that cause the rotor 220 to rotate. The stator 211 and the rotor 220 can be designed such that corresponding components are located near each other. For example, the electromagnetic coil 350 is in the vicinity of the motor permanent magnet of the rotor 220. As one example, the electromagnetic coil 350 is constructed similar to a permanent magnet motor stator, including laminations with slots filled with coil sets constructed to form three phases with which a produced magnetic field can be sequentially altered to react against a motor permanent magnetic field and impart torque on a motor permanent magnet, thereby causing the rotor 220 to rotate. As shown in FIG. 3, there can be an air gap between the stator 211 and the rotor 220. The air gap can be unsealed and of sufficient size to allow fluid flow through the air gap between the electromagnetic coil 350 and the motor permanent magnet.

The stator 211 can include an electrical connection 306. The electrical connection 306 can be connected to the electromagnetic coil 350. The electrical connection 306 can include a cable positioned in an annulus, such as the inner bore 116 between the casing 112 and the production tubing 128. The annulus can be filled with completion fluid, and the completion fluid can include a corrosion inhibitor in order to provide protection against corrosion of the electrical connection 306. The electrical connection 306 can be connected to a power source located at a remote location (such as another location within the well 500 or at the surface 106) via the cable to supply power to the electromagnetic coil 350 and/or other electrical components of the stator 211. The electrical connection 306 can be can be configured to prevent fluid from entering and exiting stator 211 through the electrical connection 306. The electrical connection 306 can be used to supply power and/or transfer information. Although shown as having one electrical connection 306, the ESP 200 can include additional electrical connections.

In some implementations, the stator chamber 210 can house the additional components. In some implementations, the stator chamber 210 includes one or more sensors (not shown) which can be configured to measure one or more properties (such as a property of the well 100, a property of the stator 211, and a property of the rotor 220). Some non-limiting examples of properties that can be measured by the one or more sensors are pressure (such as downhole pressure), temperature (such as downhole temperature or temperature of the stator 211), fluid flow (such as production fluid flow), fluid properties (such as viscosity), fluid composition, a mechanical load (such as an axial load or a radial load), and a position of a component (such as an axial position or a radial position of the rotor 220).

In some implementations, the stator chamber 210 includes a cooling circuit 380 configured to remove heat from the stator 211. The cooling circuit 380 can include a coolant that is provided from a topside of the well 100 (for example, a location at the surface 106), for example, through a tube located in the annulus 116 between the casing 112 and the production tubing 128. The coolant can enter the stator 211 through a sealed port and flow through the stator 211 to remove heat from the stator 211. In some implementations, the cooling circuit 380 circulates coolant within the stator chamber 210 to remove heat from various components (or a heat sink) of the stator chamber 210. In some implementations, the cooling circuit 380 can also provide cooling to the electrical connection 306. For example, the cooling circuit 380 can run through the annulus 116 between the casing 112 and the production tubing 128 along (or in the vicinity of) the electrical connection 306. In some implementations, the cooling circuit 380 circulates coolant within portions of the stator chamber 210 where heat dissipation to the production fluid is limited. The cooling circuit 380 can circulate coolant within the stator chamber 210 to lower the operating temperature of the stator chamber 210 (which can help to extend the operating life of the ESP 200), particularly when the surrounding temperature of the environment would otherwise prevent the ESP 200 from meeting its intended operating life. Some non-limiting examples of components that can benefit from cooling by the cooling circuit 380 are the electromagnetic coil 350 and any other electrical components. In some implementations, the cooling circuit 380 includes a jacket 384 positioned within the stator chamber 210 through which the coolant can circulate to remove heat from the stator 211 and/or other components of the stator chamber 210. In some implementations, the jacket 384 is in the form of tubing or a coil positioned within the stator 211 through which the coolant can circulate to remove heat from the stator 211 and/or other components of the stator chamber 210. In some implementations, the coolant can be isolated within the cooling circuit 380 by the jacket 384 and not directly interact with other components of the stator chamber 210. That is, the other components of the stator chamber 210 (such as electromagnetic coil 350) are not flooded by the coolant of the cooling circuit 380. In some implementations, coolant is not circulated through the cooling circuit 380 (that is, coolant is not continuously supplied to the cooling circuit 380 from the surface 106). Instead, portions of the stator chamber 210 are simply flooded with coolant.

The coolant circulating through the cooling circuit 380 can be pressurized. The pressurized coolant circulating through the cooling circuit 380 can provide various benefits, such as supporting the protective sleeve 390 and reducing the differential pressure (and in some cases, equalizing the pressure) across the stator 211 between the cooling circuit 380 and the surrounding environment of the stator chamber 210. In some implementations, the cooling circuit 380 includes an injection valve 382, which can be used to inject coolant into the production fluid. The coolant can include additives, such as scale inhibitor and wax inhibitor. The coolant including scale and/or wax inhibitor can be injected into the production fluid using the injection valve 382 in order to mitigate, minimize, or eliminate scaling and/or paraffin wax buildup in the well 100.

Fluids that are non-corrosive can be suitable as coolants. A non-limiting example of a coolant that can be used include dielectric fluid. In some implementations, the coolant can also serve as lubrication fluid. In some implementations, coolant is supplied to some portions of the stator chamber 210, and lubrication fluid is supplied to other portions of the stator chamber 210. For example, coolant can be supplied to remove heat from the electromagnetic coil 350, while lubrication fluid can be supplied to the bearings of the stator chamber 210. In such cases, the lubrication fluid can be supplied in a separate line from the cooling circuit 380. In some implementations, lubrication fluid is not circulated through the stator chamber 210; instead, portions of the stator chamber 210 are simply flooded with lubrication fluid.

The rotor 220 can include a protective sleeve 490. The protective sleeve 490 can surround the rotor 220 and can be similar to the protective sleeve 390 lining the inner diameter of the stator chamber 210. The protective sleeve 490 can be metallic or non-metallic. For example, the protective sleeve 490 can be made of carbon fiber or Inconel.

In some implementations, the rotor 220 includes an isolation sleeve 492. The isolation sleeve 492 defines an outer surface of the rotor 220. In some implementations, the isolation sleeve 492 allows production fluid to flow through the rotor 220 through an inner bore of the isolation sleeve 492, but not across the outer surface of the isolation sleeve 492. In some implementations, the volume defined between the isolation sleeve 492 and the protective sleeve 390 of the stator chamber 210 is isolated from production fluids. The isolation sleeve 492 can prevent the protective sleeve 390 of the stator chamber 210 from being exposed to production fluids, thereby reducing or eliminating the risk of corrosion and/or erosion of the protective sleeve 390 due to production fluid flow (and in turn, increasing the reliability and operating life of the ESP 200). The isolation sleeve 492 can be metallic or non-metallic. For example, the isolation sleeve 492 can be made of carbon fiber or Inconel.

The ESP 200 can include additional components. Components of the stator chamber 210 and components of the rotor 220 can be cooperatively configured to counteract a mechanical load experienced by the ESP 200 during rotation of the rotor 220. In some implementations, the ESP 200 includes duplicate components (such as multiple motor rotors 220) that can act together or independently to provide higher output or redundancy to enhance long term operation. In some implementations, multiple ESPs 200 can be deployed to act together or independently to provide higher output or redundancy to enhance long term operation.

Figure 4:
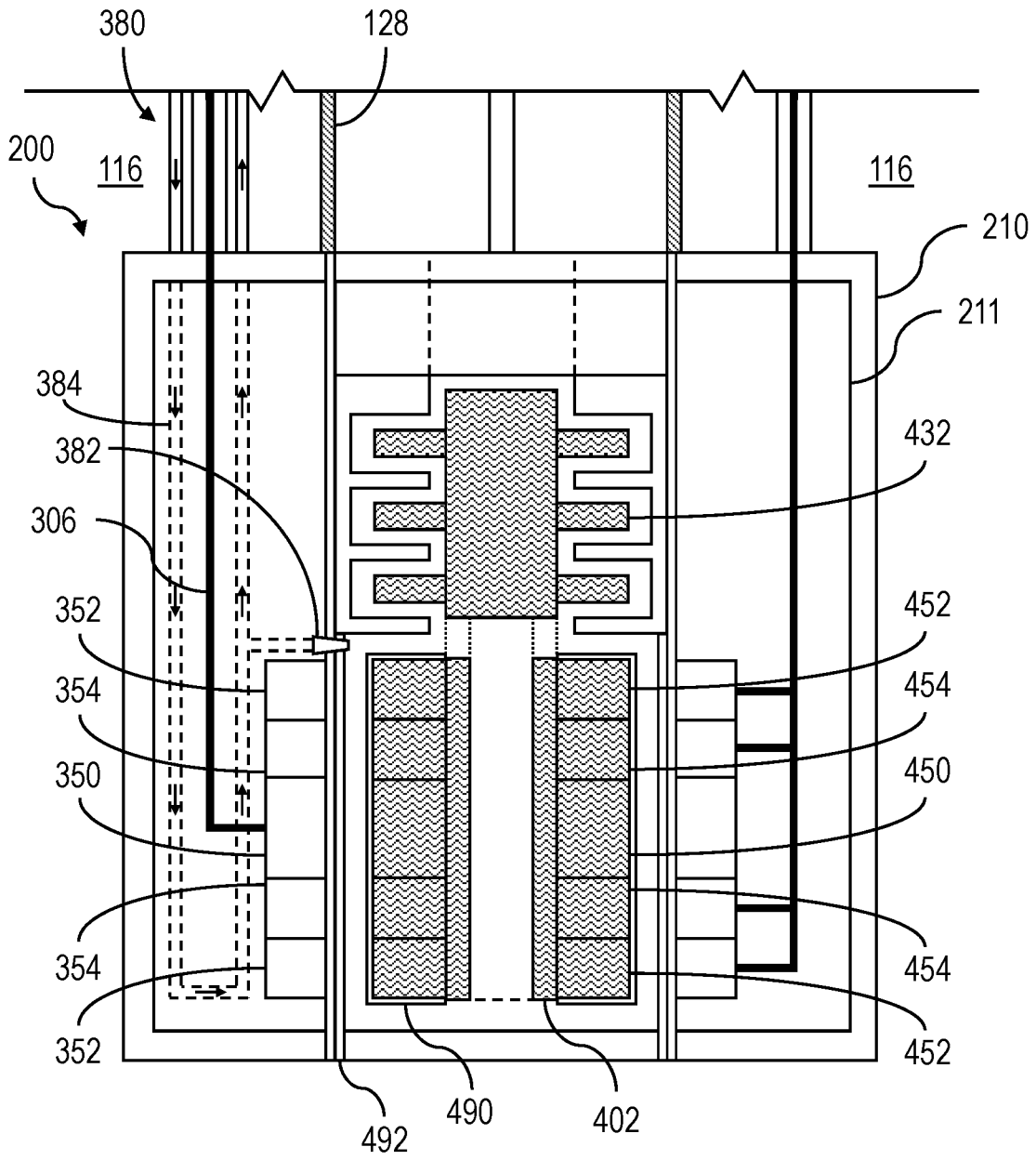
FIG. 4 is a schematic diagram of an example ESP within the well of FIG. 1.

FIG. 4 illustrates an implementation of the ESP 200. The stator chamber 210 can include one or more thrust bearing actuators 352. The thrust bearing actuators 352 can be, for example, thrust bearing permanent magnets (passive) or thrust bearing electromagnetic coils (active). In the case of thrust bearing electromagnetic coils, the thrust bearing actuators 352 can be connected to topside circuitry, for example, by a cable running through the annulus 116. The stator chamber 210 can include one or more radial bearing actuators 354. The radial bearing actuators 354 can be, for example, radial bearing permanent magnets (passive) or radial bearing electromagnetic coils (active). In the case of radial bearing electromagnetic coils, the radial bearing actuators 354 can be connected to topside circuitry, for example, by the cable running through the annulus 116. In some implementations, the thrust bearing actuators 352 and the radial bearing actuators 352 are connected to a magnetic bearing controller located at the surface 106.

The arrows represent the flow direction of the coolant circulating in the cooling circuit 380. The configuration of the cooling circuit 380 and the flow direction of the coolant circulating in the cooling circuit 380 can be different from the example shown in FIG. 4. Although shown as having separate connections in FIG. 4, in some implementations, the coolant can be supplied through an umbilical that also houses the electrical connection 306.

The rotor 220 can include one or more thrust bearing targets 452. The thrust bearing targets 452 can be, for example, metallic stationary poles (solid or laminated), rotating metallic poles (solid or laminated), and/or permanent magnets. The retrievable string 400 can include one or more radial bearing targets 454. The radial bearing targets 454 can be, for example, metallic stationary poles (solid or laminated), rotating metallic poles (solid or laminated), and/or permanent magnets. The thrust bearing targets 452 and the radial bearing targets 454 can both be comprised of stationary components (for example, for conducting magnetic fields in a specific path) and rotating components. For example, the thrust bearing target 452 can include a solid metallic pole that conducts a magnetic field from a stator coil (such as the thrust bearing actuator 352). The magnetic field from the stator coil (352) is radial, and the solid metallic pole (of the thrust bearing target 452) can conduct the radial magnetic field to an axial magnetic field, at which point the magnetic field crosses a gap between a stationary pole and a rotating pole, thereby imparting a force between the stationary pole and the rotating pole.

As shown in FIG. 4, the stator chamber 210 is spaced from the rotor 220 to define an air gap between the stator chamber 210 (which can include the thrust bearing actuators 352 and the radial bearing actuators 354) and the rotor 220 (which can include the thrust bearing targets 452 and the radial bearing targets 454). The air gap can be unsealed and of sufficient size to allow fluid flow through the air gap between the bearing actuators (352, 354) and the bearing targets (452, 454) of the ESP 200. The thrust bearing targets 452 and the radial bearing targets 454 are coupled to the rotor 220 and can be covered by the protective sleeve 490. The protective sleeve 490 can prevent the bearing targets (452, 454) and the motor permanent magnet 450 from being exposed to production fluid.

As shown in FIG. 4, the electrical components and electric cables of the ESP 200 can be reserved for the stator chamber 210, and the rotor 220 can be free of electrical components and electric cables. Various components of stator chamber 210 (such as the electromagnetic coil 350, the thrust bearing actuators 352, and the radial bearing actu2ators 354) are sources of magnetic flux and can include electrical components. The generated magnetic fluxes can interact with targets (for example, a permanent magnet) to achieve various results, such as rotation of the rotor 220 in the case of the motor permanent magnet 450, translation in the case of a linear motor, axial levitation of the rotor 220 in the case of thrust bearing targets 452, and radial levitation of the rotor 220 in the case of the radial bearing targets 454.

The thrust bearing actuators 352 and the thrust bearing targets 452 are cooperatively configured to counteract axial (thrust) loads on the rotor 220. The thrust bearing actuators 352 and the thrust bearing targets 452 work together to control an axial position of the rotor 220 relative to the ESP 200. For example, the thrust bearing actuators 352 and the thrust bearing targets 452 interact magnetically (that is, generate magnetic fields to exert attractive or repulsive magnetic forces) to maintain an axial position of the rotor 220 relative to the ESP 200 while the rotor 220 rotates.

Similarly, the radial bearing actuators 354 and the radial bearing targets 454 are cooperatively configured to counteract radial loads on the rotor 220. The radial bearing actuators 354 and the radial bearing targets 454 work together to control a radial position of the rotor 220 relative to the ESP 200. For example, the radial bearing actuators 354 and the radial bearing targets 454 interact magnetically (that is, generate magnetic fields to exert attractive or repulsive magnetic forces) to maintain a radial position of the rotor 220 relative to the ESP 200 while the rotor 220 rotates.

In some implementations, the ESP 200 includes a damper (for example, a passive damper and/or an active damper). The damper includes a stationary portion (which can include electrical components) that can be installed as a part of the stator chamber 210. The damper includes a rotating portion (which can include a permanent magnet) that can be installed as a part of the rotor 220. A damper magnetic field can be generated by a permanent magnet rotating with the rotor 220. The damper can damp a vibration of the rotor 220. The damper can include a damper magnet positioned between or adjacent to the bearing actuators (352, 354). The vibration of the rotor 220 can induce a vibration in the damper magnet. In some implementations, the damper magnet includes a first damper magnet pole shoe and a second damper magnet pole shoe coupled to a first pole (North) and a second pole (South), respectively. The first damper magnet pole shoe and the second damper magnet pole shoe can maintain uniformity of the magnetic fields generated by the damper magnet. In some implementations, a damper sleeve is positioned over the outer diameters of the damper magnet, the first damper magnet pole shoe, and the second damper magnet pole shoe.

In some implementations, for active dampers, one or more radial velocity sensing coils can be placed in a plane adjacent to the first damper magnet pole shoe and coupled to the first pole of the damper magnet. The one or more radial velocity sensing coils can be installed as a part of the stator chamber 210 and be exposed to a magnetic field emanating from the first pole of the damper magnet. Radial movement of the damper magnet can induce an electrical voltage in the one or more radial velocity sensing coils. The damper magnet can face the one or more radial velocity sensing coils with the first pole. In some implementations, a second damper sensing magnet is positioned axially opposite the one or more radial velocity sensing coils and oriented to face the one or more radial velocity sensing coils with a pole opposite the first pole. A printed circuit board can include the one or more radial velocity sensing coils.

For active dampers, one or more radial damper actuator coils can be placed in a second plane adjacent to the second damper magnet pole shoe and coupled to the second pole of the damper magnet. The one or more radial damper actuator coils can be installed as a part of the stator chamber 210 and be exposed to a magnetic field emanating from the second pole of the damper magnet. An electrical current in the one or more radial damper actuator coils can cause a force to be exerted on the damper magnet. The damper magnet can face the one or more radial damper actuator coils with the second pole. In some implementations, a second damper sensing magnet is positioned axially opposite the one or more radial damper actuator coils and oriented to face the one or more radial damper actuator coils with a pole opposite the second pole. A printed circuit board can include the one or more radial damper actuator coils.

As shown in FIG. 4, the electrical components of the ESP 200 are positioned in the portions related to the stator chamber 210, and electric cables run through the annulus 116 which can be filled with completion fluid including corrosion inhibitor. In this way, the electrical components can be isolated from the producing portion of the well 100, which can contain fluids that are potentially damaging to the cables (for example, by corrosion, abrasion, or erosion).

Figure 5A:
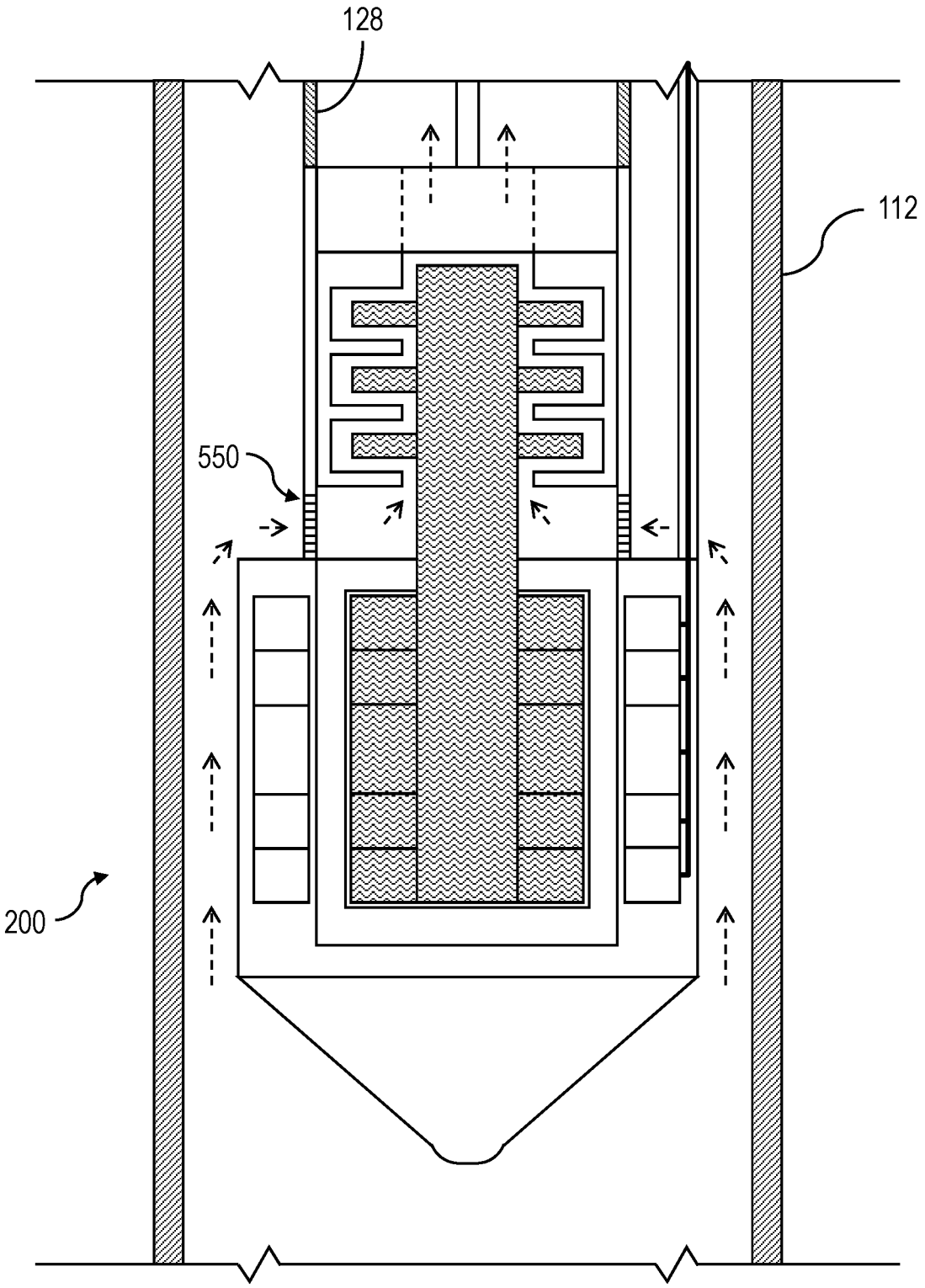
FIGS. 5A, 5B, 5C, 5D, and 5E are schematic diagrams of examples of ESPs within the well of FIG. 1.

FIGS. 5A, 5B, 5C, and 5D show various implementations of the ESP 200 that can be installed in the well 100. As shown in FIG. 5A, in some implementations, the production fluid from the subterranean zone 110 can flow (dotted arrows) around the outer surface of the stator chamber 210, with the possible use of apertures 550 and into the ESP 200 at an inlet. The apertures 550 can be, for example, oriented inlet slots and/or perforations. The apertures 550 can be radial apertures 550. In such implementations, production fluid can be present in the rotor 220 inner bore and annulus between rotor 220 and stator chamber 210, but not serve as the primary flow path of the production fluid from the subterranean zone 110 to the inlet of the ESP 200. In some implementations, the seal 126 used to isolate the production fluid from the outside of the stator chamber 210 is not included, and production fluid exits the ESP 200 into the production tube 128. In some implementations, the ESP 200 includes a rounded head.

Figure 5B:
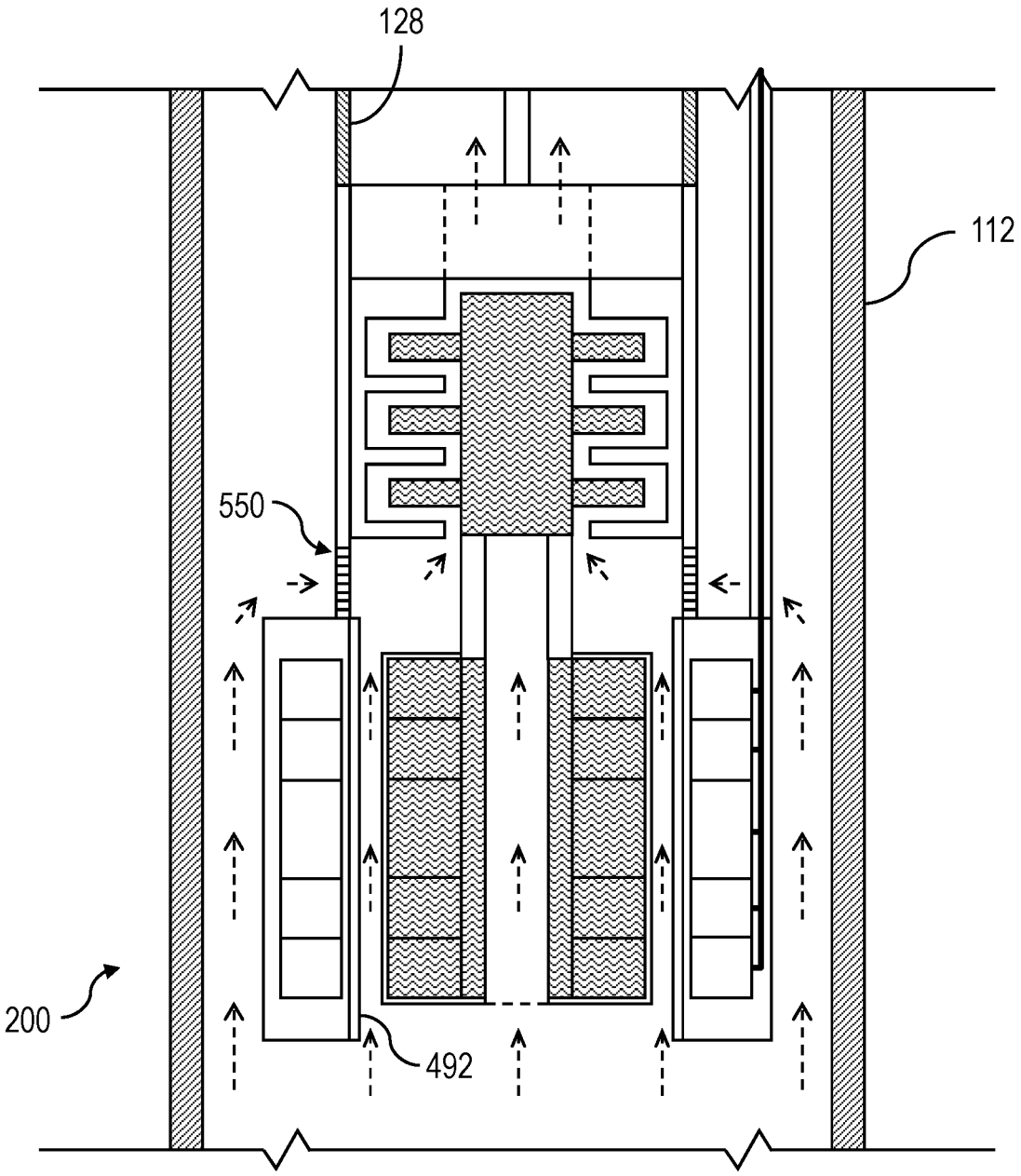

As shown in FIG. 5B, in some implementations, production fluid from the subterranean zone 110 can flow (dotted arrows) around the outer surface of the stator chamber 210, with the possible use of the apertures 550 and through the rotor 220 inner bore and annulus between rotor 220 and stator chamber 210 to an inlet of the ESP 200. Production fluid flow through the rotor 220 inner bore and annulus between rotor 220 and stator chamber 210 can be implemented to provide adequate production fluid flow to adequately cool the rotor 220.

Figure 5C:
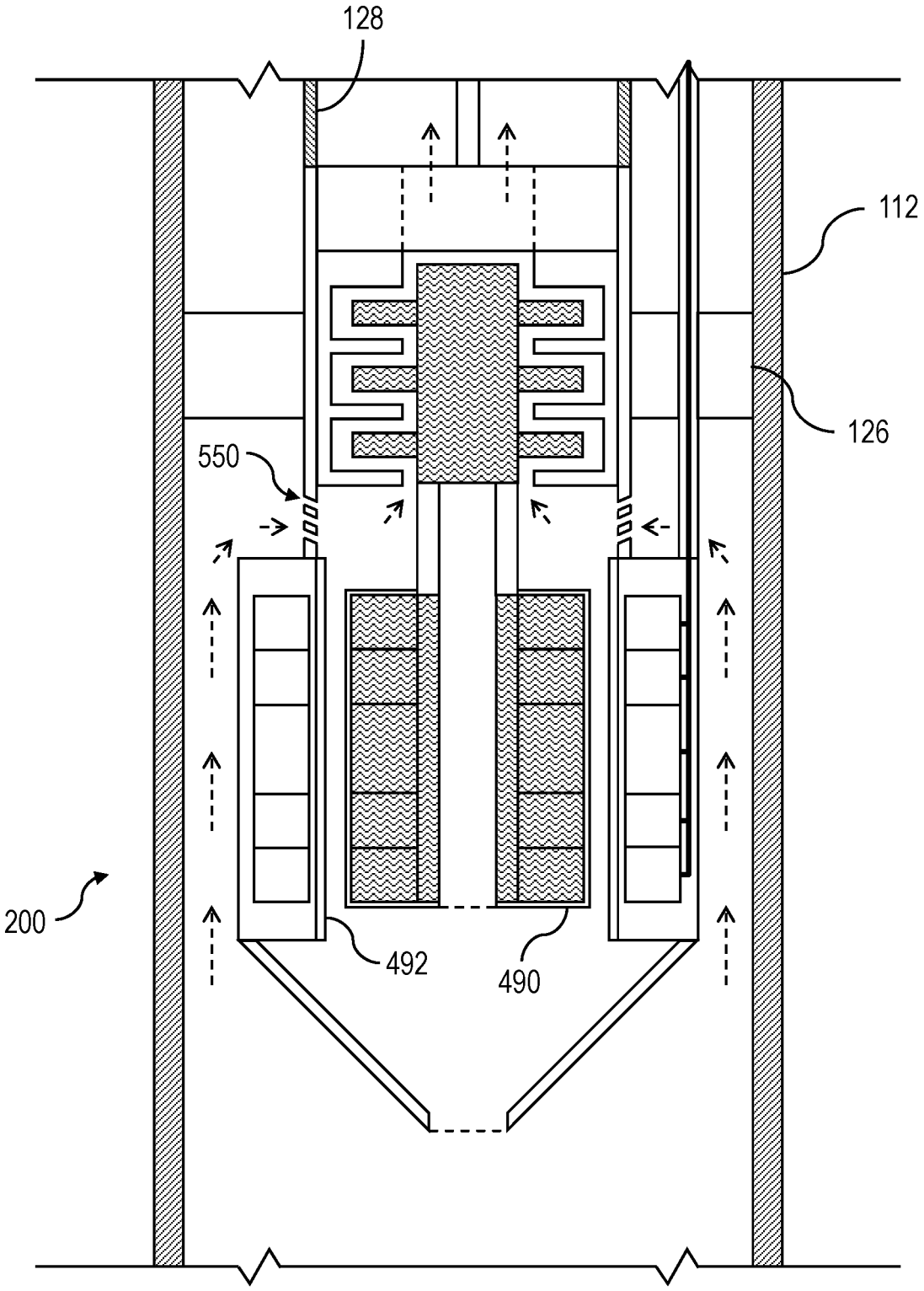

As shown in FIG. 5C, in some implementations, production fluid flow can flow through the rotor 220 inner bore and annulus between rotor 220 and stator chamber 210 to an inlet of the ESP 200. The annulus between the well bore 116 and the outer surface of the stator chamber 210 can be open to the production fluid and a seal, for example the packer 126, placed after (that is, downstream of) the ESP 200 inlet but before (that is, upstream of) the ESP 200 outlet. The apertures 550, for example, can be located at the top of the motor but below the packer 126, and the apertures 550 can allow liquid/solids to separate out to the annulus between the well bore 116 and the outer surface of the stator chamber 210, so that solids can drop while fluid can circulate back to the motor inlet. Any solids can drop through a central bore, for example, at the head of the ESP 200.

Figure 5D:
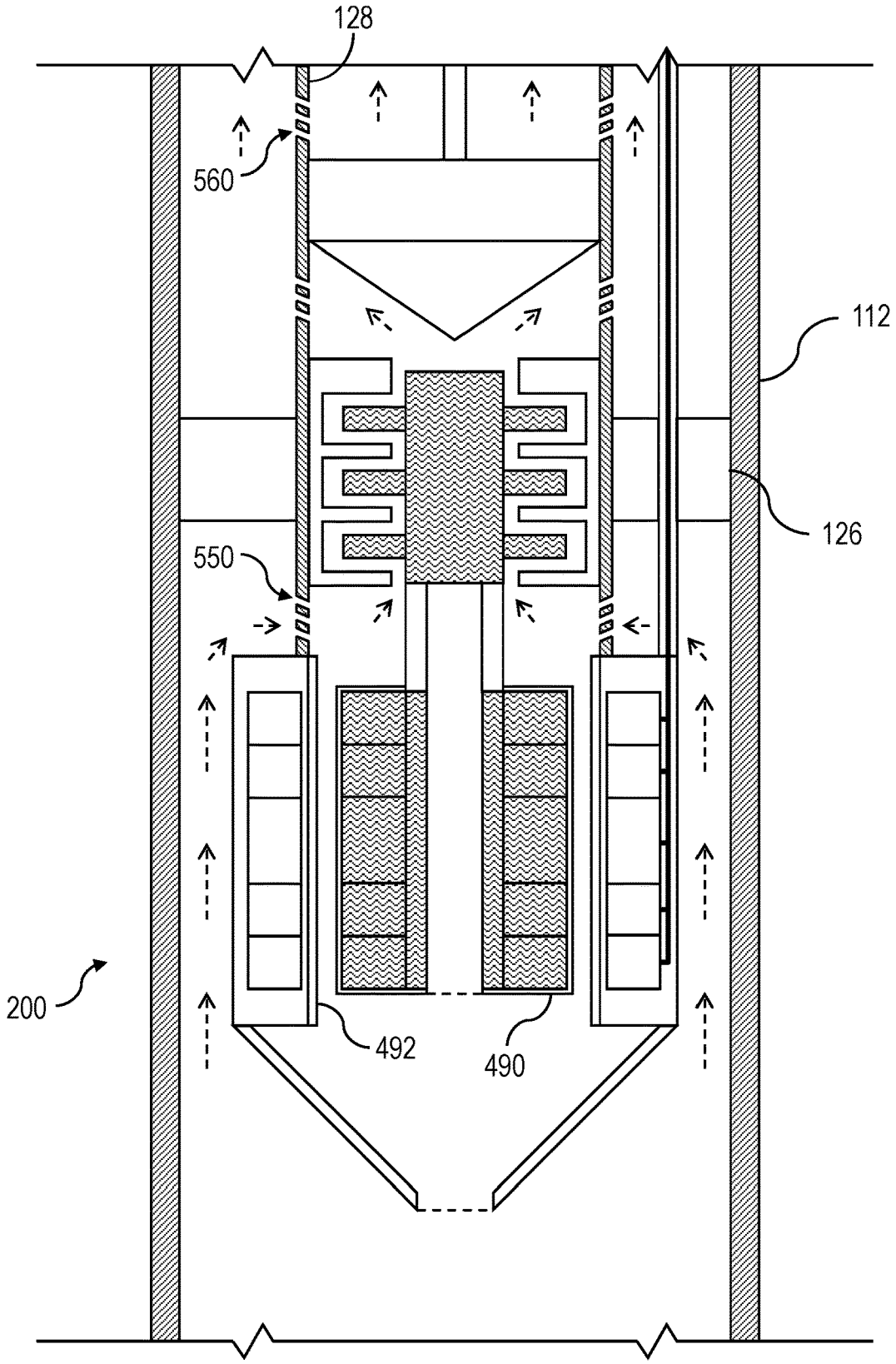

As shown in FIG. 5D, in some implementations, production fluid flow can flow through the rotor 220 inner bore and annulus between rotor 220 and stator chamber 210 to an inlet of the ESP 200. In such implementations, apertures 550 at the top of the motor in the annulus between the well bore 116 and the outer surface of the stator chamber 210 can be used to allow liquid and/or solids to separate in the annulus between the well bore 116 and the outer surface of the stator chamber 210. Any production fluid present can be ported to the ESP 200 inlet section again with apertures 550. An isolation above the ESP 200 can be implemented to keep this intermediate annulus separate from the annulus that is defined up to the wellhead. In some implementations, the ESP 200 includes a gas separator 560 to separate liquid and gas phases of the production fluid. For example, gas can pass through the central core through the rotor 220 inner bore and annulus between rotor 220 and stator chamber 210 and be brought out above the ESP 200 and funneled out to the annulus that continues all the way to the wellhead. This gas can then be produced through the annulus while the liquid is produced through the tubing 128.

Figure 5E:
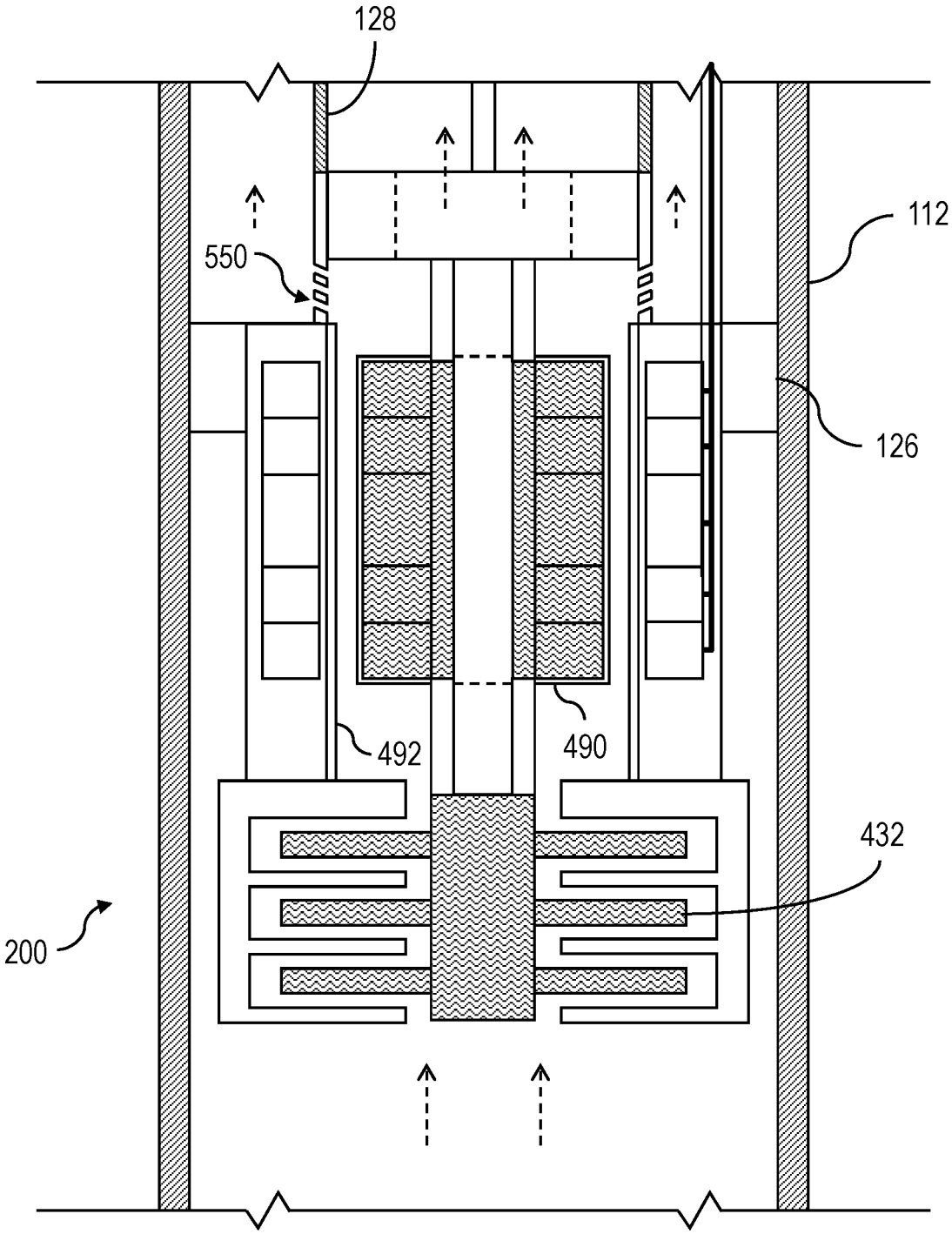

As shown in FIG. 5E, the pump section (the portion of the ESP 200 including the impellers 432) can be located below the motor section of the ESP 200. In such implementations, motor cables (such as the electrical connection 306) and auxiliary components (such as the cooling circuit 380) do not pass the pump section, and thus impose spatial limitations on the pump section. Therefore, the pump section can be larger in size than if the pump needed to accommodate the cables and auxiliary components. A larger pump section can provide more lift (for example, by increased size of the impellers 432). A larger pump section can achieve the same pumping performance with of pump stages. A larger pump section can allow for more room for fluid to travel through the ESP 200, thereby reducing pump losses (for example, frictional losses). Similar to other previously described implementations, the ESP 200 can include apertures 550 which can allow gas and liquid phases to be produced in separate sections (for example, inside and outside the production tubing 128).

The various components described can be applicable to implementations of the ESP 200 described. For example, the ESPs 200 shown in FIGS. 5A through 5D can include a cooling circuit 380 even though the cooling circuit 380 is not shown in these figures. In some implementations, multiple ESPs 200 may be installed within the same well 100.

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

In this disclosure, "approximately" means a deviation or allowance of up to 10 percent (%) and any variation from a mentioned value is within the tolerance limits of any machinery used to manufacture the part. Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise. "About" can allow for a degree of variability in a value or range, for example, within 10%, within 5%, or within 1% of a stated value or of a stated limit of a range.

While this disclosure contains many specific implementation details, these should not be construed as limitations on the scope of the subject matter or on the scope of what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example implementations do not define or constrain this disclosure. Other changes, substitutions, and alterations are also possible without departing from the spirit and scope of this disclosure.

What is claimed is:

1. An electric submersible pump, comprising:

a stator chamber configured to reside in a wellbore, the stator chamber configured to attach to a tubing of a well, the stator chamber defining an inner bore having an inner bore wall that, when the stator chamber is attached to the tubing, is continuous with an inner wall of the tubing and the stator chamber, when the stator chamber is attached to the tubing, is configured to define an annulus exterior the stator chamber in the well;

a stator within the stator chamber, wherein the stator chamber is flooded with a coolant configured to remove heat from the stator;

a rotor positioned within the inner bore of the stator chamber, the rotor comprising an impeller, the rotor configured to be retrievable from the well while the stator remains in the well; and an electrical connection connected to the stator chamber, the electrical connection configured to supply power to electrical components of the stator, the stator configured to drive the rotor to rotate the impeller and induce well fluid flow in response to receiving power through the electrical connection.

2. The electric submersible pump of claim 1, comprising a fluid connection connected to the stator chamber, the fluid connection configured to supply coolant to the stator chamber from a remote location.

3. The electric submersible pump of claim 2, wherein the fluid connection comprises an injection valve configured to inject coolant into the well fluid.

4. The electric submersible pump of claim 2, wherein when the electric submersible pump is installed in the well, the fluid connection runs from the remote location to the stator chamber through an annulus defined between a casing of the well and the tubing of the well.

5. The electric submersible pump of claim 1, wherein the rotor defines an inner bore through which fluid can flow once the electric submersible pump is installed in the well.

6. The electric submersible pump of claim 1, wherein the stator chamber defines a plurality of radial apertures configured to allow fluid to flow radially into or out of an inner bore of the stator chamber.

7. The electric submersible pump of claim 6, wherein the plurality of radial apertures is configured to allow fluid to flow into or out from the inner bore of the stator chamber and into or out from an annulus between the stator chamber and a wall of the well.

8. The electric submersible pump of claim 6, wherein the plurality of radial apertures comprises a first set of radial apertures, and the first set of radial apertures is located downhole of the impeller when the electric submersible pump is attached to the tubing of the well.

9. The electric submersible pump of claim 8, wherein the plurality of radial apertures comprises a second set of radial apertures, and the second set of radial apertures is located uphole of the impeller when the electric submersible pump is attached to the tubing of the well.

10. The electric submersible pump of claim 1, comprising a downhole end defining an opening, the opening configured to allow solid material to fall out of the electric submersible pump, such that the solid material is not produced with the well fluid.

11. The electric submersible pump of claim 1, comprising a protector located at a downhole end of the electric submersible pump, the protector comprising a bearing configured to control levitation of the rotor within the inner bore of the stator chamber.

12. The electric submersible pump of claim 1, wherein the stator chamber houses a magnetic bearing.

13. The electric submersible pump of claim 1, comprising a damper configured to dampen a vibration of the rotor.

14. The electric submersible pump of claim 1, where the stator chamber is configured to define a fluid containing annulus exterior the stator chamber, between an outermost surface of the stator chamber and an innermost wall of the well.

15. A method, comprising:

installing an electric submersible pump within a well formed in a subterranean zone, the electric submersible pump comprising:

a stator chamber;

a stator within the stator chamber, the stator chamber flooded with a coolant configured to remove heat from the stator;

a rotor positioned within an inner bore of the stator chamber, the rotor comprising an impeller, the rotor configured to be retrievable from the well while the stator remains within the well; and an electrical connection connected to the stator chamber; and supplying power through the electrical connection to the stator to drive the rotor to rotate the impeller and induce well fluid flow, wherein installing the electric submersible pump within the well comprises positioning the stator chamber in the well and attaching the stator chamber to a tubing of the well, the inner bore of the stator chamber being continuous with an inner wall of the tubing, and the stator chamber defining an annulus exterior to the stator chamber in the well.

16. The method of claim 15, comprising retrieving the rotor from the well while the stator remains within the well.

17. The method of claim 16, wherein the electric submersible pump comprises a fluid connection connected to the stator chamber, and the method comprises flowing the coolant through the fluid connection to the stator chamber from a remote location.

18. The method of claim 15, comprising flowing well fluid through an inner bore of the rotor.

19. The method of claim 15, comprising flowing well fluid through a plurality of radial apertures defined by the stator chamber.

20. The method of claim 19, wherein the plurality of radial apertures comprises a first set of radial apertures located downhole of the impeller, and flowing the well fluid through the plurality of radial apertures comprises flowing at least a portion of the well fluid into an inner bore of the stator chamber through the first set of radial apertures.

21. The method of claim 20, wherein the plurality of radial apertures comprises a second set of radial apertures located uphole of the impeller, and flowing the well fluid through the plurality of radial apertures comprises flowing at least a portion of the well fluid out of the inner bore of the stator chamber through the second set of radial apertures.

22. The method of claim 15, comprising allowing solid material to fall out of the electric submersible pump through an opening defined in a downhole end of the electric submersible pump, such that the solid material is not produced with the well fluid.

23. The method of claim 15, comprising controlling levitation of the rotor within the inner bore of the stator chamber using a bearing of a protector located at a downhole end of the electric submersible pump.

24. The method of claim 15, wherein installing the electric submersible pump within the well comprises defining positioning the stator chamber in the well to define a fluid containing annulus between an outermost surface of the stator and an innermost wall of the well.

25. An electric submersible pump, comprising:

a stator chamber encasing a stator, the stator chamber configured to reside in a well and configured to be attached to a tubing of the well, the stator chamber defining an inner bore having an inner, circumferential wall that, when the stator chamber is attached to the tubing, is continuous with an inner, circumferential wall of the tubing and the stator chamber being configured, when the stator chamber is attached to the tubing, is configured to define an annulus exterior the stator chamber in the well, and wherein the stator chamber is flooded with a coolant configured to remove heat from the stator; and a rotor-impeller configured to be positioned within the inner bore of the stator chamber, the rotor-impeller configured to be retrievable from the well while the stator remains within the well.

26. The electric submersible pump of claim 25, wherein the stator chamber is configured to define a fluid containing annulus exterior the stator chamber, between an outermost surface of the stator chamber and an innermost wall of the well.

* * * * *